United States Patent [19]

Omura et al.

[11] Patent Number: 4,645,031

[45] Date of Patent: Feb. 24, 1987

[54] EXHAUST SYSTEM FOR AN INTERNAL COMBUSTION ENGINE

[75] Inventors: Hideo Omura, Yokosuka; Toshiyuki Kaminaga, Hitachi; Hirofumi Takei, Yokohama, all of Japan

[73] Assignee: Nissan Motor Company, Limited, Japan

[21] Appl. No.: 721,397

[22] Filed: Apr. 9, 1985

[30] Foreign Application Priority Data

Apr. 13, 1984 [JP] Japan ..... 59-54375[U]

[51] Int. Cl.[4] ..... F01N 1/02; F01N 1/08

[52] U.S. Cl. ..... 181/232; 181/228; 181/266; 181/272

[58] Field of Search ..... 181/228, 265, 266, 272, 181/232

[56] References Cited

U.S. PATENT DOCUMENTS

| | | | |
|---|---|---|---|
| 3,382,948 | 5/1968 | Walker et al. | 181/228 X |
| 3,543,878 | 12/1970 | Hamilton | 181/228 |
| 3,613,830 | 10/1971 | Hubbell, III | 181/266 |
| 3,655,011 | 4/1972 | Willett | 181/228 |
| 4,333,544 | 6/1982 | Seeger | 181/266 |

*Primary Examiner*—Benjamin R. Fuller

*Attorney, Agent, or Firm*—Leydig, Voit & Mayer

[57] ABSTRACT

An exhaust passage has an upstream end connected to an engine combustion chamber and a downstream end open to the atmosphere. A device substantially equalizes natural frequencies of the exhaust passage respectively corresponding to third-degree and fourth-degree modes of standing pressure waves developing in the exhaust passage. A pressure damper is connected to a point of the exhaust passage at which an antinode of the third-degree or fourth-degree mode lies.

9 Claims, 10 Drawing Figures

EXHAUST SYSTEM FOR AN INTERNAL COMBUSTION ENGINE

BACKGROUND OF THE INVENTION

This invention relates to an exhaust system for an internal combustion engine.

In internal combustion engines, cyclic movement of exhaust valves causes pressure pulsations or surges which travel through exhaust systems. The frequency of the exhaust pressure surges increases with engine rotational speed. When the frequency of the exhaust pressure surges is equal to one of the resonant frequencies of the exhaust system, annoying exhaust noises develop.

SUMMARY OF THE INVENTION

It is an object of this invention to provide an exhaust system for an internal combustion engine which damps exhaust noises effectively.

In accordance with this invention, an exhaust system includes an exhaust passage having an upstream end connected to an engine combustion chamber and a downstream end open to the atmosphere. A device substantially equalizes natural frequencies of the exhaust passage respectively corresponding to third-degree and fourth-degree modes of standing pressure waves developing in the exhaust passage. A pressure damper is connected to a point of the exhaust passage at which an antinode of the the third-degree or fourth-degree mode lies.

BRIEF DESCRIPTION OF THE DRAWINGS

Corresponding elements are denoted by the same reference characters throughout FIGS. 1 to 3.

Corresponding elements are denoted by the same reference characters throughout FIGS. 5 and 7.

Corresponding elements are denoted by the same reference characters throughout FIGS. 8 to 10.

DESCRIPTION OF THE PREFERRED EMBODIMENTS

Figure 1:
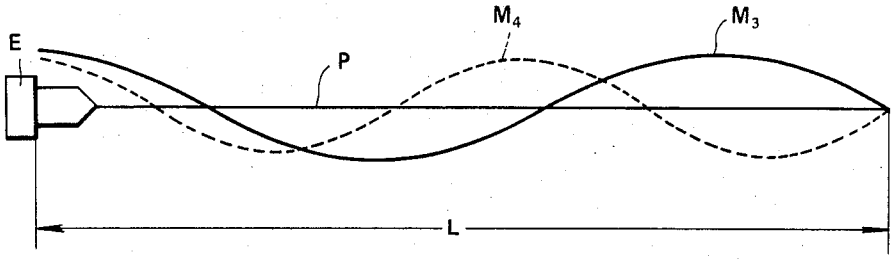
FIG.1 PRIOR ART
FIG. 1 is a diagram of a primitive exhaust system for an internal combustion engine.

In a primitive exhaust system of FIG. 1, an exhaust passage P has an upstream end connected to combustion chambers of an internal combustion engine E and a downstream end open to the atmosphere. The exhaust passage P has an effective length L equal to the effective distance between its upstream and downstream ends.

A third-degree mode M3 of standing pressure wave developing in the exhaust passage P has three nodes as well as three antinodes or extrema. A fourth-degree mode M4 of standing pressure wave developing in the exhaust passage P has four nodes as well as four antinodes for extrema. Natural frequencies f3 and f4 of the exhaust passage P for the third-degree and fourth-degree modes M3 and M4 respectively are given as follows:

$$f3=(5c)/(4L),$$

$$f4=(7c)/(4L),$$

where c represents sonic or sound velocity.

In the case of 4-cycle n-cylinder engines (n represents the number of engine cylinders), pressure pulsations or surges resulting from periodic movement of exhaust valves have a fundamental component, the frequency f0 of which is given as follows:

$$f0=(R/60)\cdot(n/2),$$

where R represents engine rotational speed in units of r.p.m.

When the pressure pulsation frequency f0 becomes equal to one of the natural frequencies of the exhaust passage P, the level of exhaust noise increases due to resonance.

Figure 2:
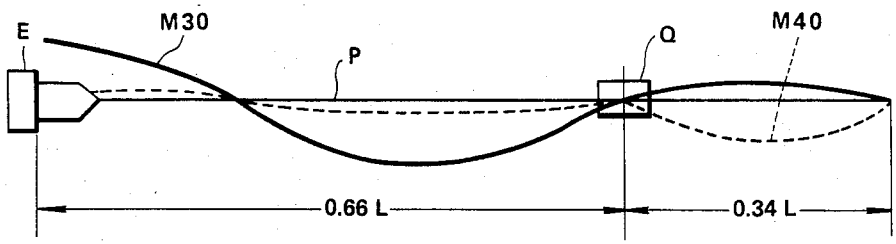
FIG. 2 is a diagram of an exhaust system for an internal combustion engine.

In an exhaust system of FIG. 2, a muffler Q is added to the system of FIG. 1. The muffler Q is connected to the exhaust passage P at an effective distance 0.66L from the upstream end of the exhaust passage. In this system, the third-degree and fourth-degree modes M3 and M4 of FIG. 1 are changed to corresponding modes M30 and M40. As shown in FIG. 2, the third-degree mode M30 is dominant in the segment of the exhaust passage P upstream of the muffler Q, while the fourth-degree mode M40 is dominant in the rest of the exhaust passage P. It should be noted that the natural frequencies f3 and f4 are slightly changed to values f30 and f40 for the third-degree and fourth-degree modes M30 and M40.

Figure 3:
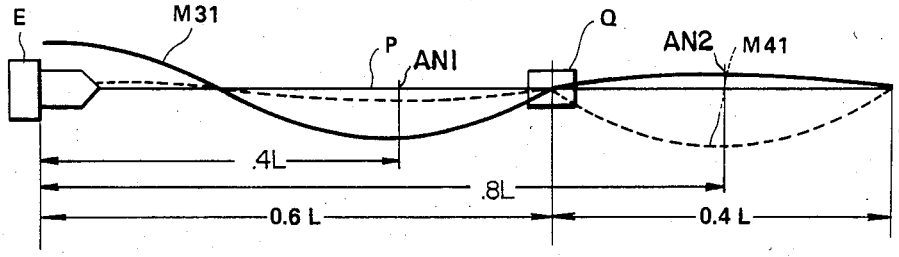
FIG. 3 is a diagram of an exhaust system for an internal combustion engine which is regarded as a material or basis for this invention.

FIG. 3 shows an exhaust system constituting a material or basis for this invention. The basic system is similar to the system of FIG. 2 except for the location of the muffler Q. A point of the connection of the exhaust passage P to the muffler Q is separated from the upstream end of the exhaust passage P by an effective length 3L/5, that is, 0.6L. In other words, an effective length between the muffler Q and the downstream end of the exhaust passage P is 2L/5, that is, 0.4L.

In the basic system of FIG. 3, the third-degree and fourth-degree modes M30 and M40 in the system of FIG. 2 are changed to corresponding modes M31 and M41. As shown in FIG. 3, the third-degree mode M31 is dominant in the segment of the exhaust passage P upstream of the muffler Q, while the fourth-degree mode M41 is dominant in the rest of the exhaust passage P. Both of these modes M31 and M41 have antinodes AN1 and AN2 at a point of the exhaust passage P which is separated from the upstream end of the exhaust passage P by an effective length 4L/5, that is, 0.8L, and at another point of the passage P which is separated from the upstream end by an effective length 2L/5, that is, 0.4L. As will be made clear hereafter, the muffler Q has the effect of substantially equalizing natural frequencies f31 and f41 corresponding to the third-degree and fourth-degree modes M31 and M41.

Figure 4:
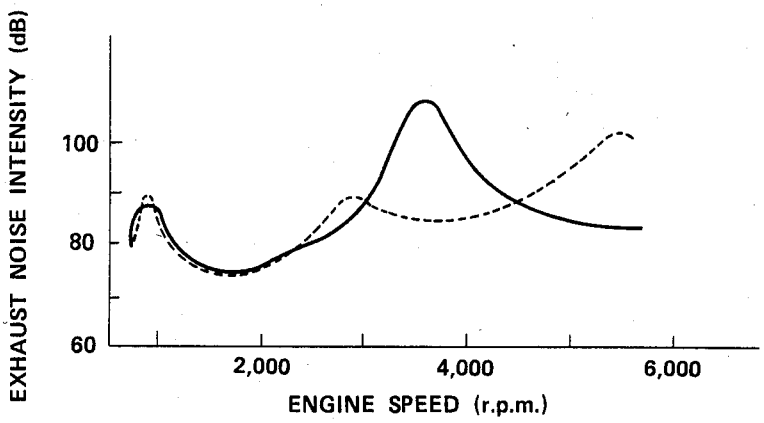
FIG. 4 is a graph of the relationship between exhaust noise intensity and engine rotational speed in the systems of FIGS. 2 and 3.

The broken line of FIG. 4 represents the relationship between the intensity of exhaust noise and the engine rotational speed in the system of FIG. 2. As illustrated, the level of exhaust noise peaks at an engine speed of about 3,000 r.p.m. where the pressure pulsation frequency f0 is equal to a natural frequency f30 of the system corresponding to the third-degree mode M30. The level of exhaust noise also peaks at an engine speed of about 5,400 r.p.m. where the pressure pulsation frequency f0 is equal to a natural frequency f40 of the system corresponding to the fourth-degree mode M40.

The solid line of FIG. 4 represents the relationship between the intensity of exhaust noise and the engine rotational speed in the system of FIG. 3. As illustrated, the level of exhaust noise peaks strongly at an engine speed of about 3,500 r.p.m. where the pressure pulsation frequency f0 is substantially equal to the natural frequencies f31 and f41 corresponding to the third-degree and fourth-degree modes M31 and M41. There is only a single peak in the exhaust noise level at engine speeds above 2,000 r.p.m., since the muffler Q tends to equalize the natural frequencies f31 and f41 of the system.

Figure 5:
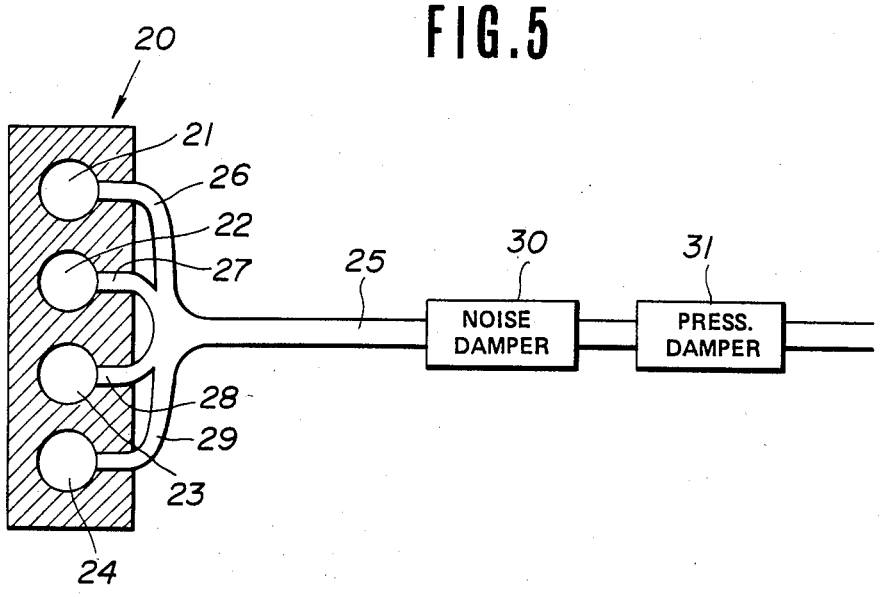
FIG. 5 is a diagram of an exhaust system for an internal combustion engine according to a first embodiment of this invention.

FIG. 5 shows a first embodiment of this invention. In this embodiment, an internal combustion engine 20 has four cylinders 21, 22, 23, and 24. An exhaust passage 25 has an upstream end forked into four branches 26, 27, 28, and 29 connected to the combustion chambers 21, 22, 23, and 24 respectively. The exhaust passage 25 has a downstream end open to the atmosphere. The effective length of the exhaust passage 25 represented by the letter L is equal to the effective distance between its upstream and downstream ends, that is, the effective distance between a mean position of its connections to the combustion chambers and its downstream end. It should be noted that the exhaust passage 25 is physically made up of exhaust ports in the engine cylinder head, an exhaust manifold, and exhaust pipes.

An exhaust noise damper 30, such as a muffler, is connected to the exhaust passage 25 at a point approximately 3L/5 distant from the upstream end of the exhaust passage 25. This arrangement is similar to the location of the muffler Q of FIG. 3.

A pressure damper or absorber 31 is connected to the exhaust passage 25 at a point approximately 4L/5 distant (0.8L distant) from the upstream end of the exhaust passage 25, which corresponds to the location of antinode AN2 in FIG. 3. It should be noted that antinodes of the modes M31 and M41 of FIG. 3 lie at this point.

Figure 6:
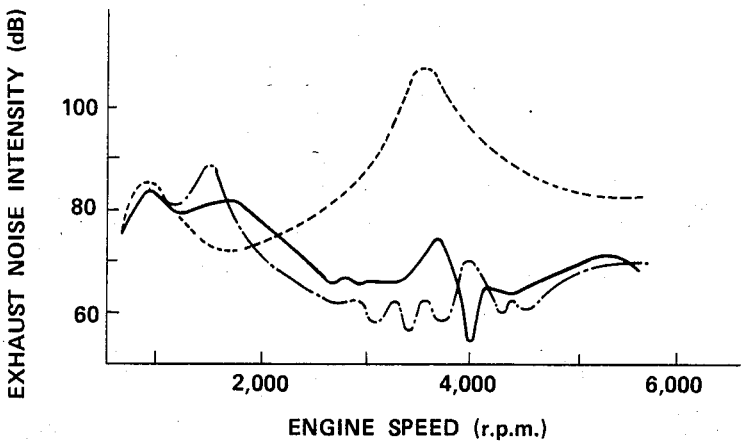
FIG. 6 is a graph of the relationship between exhaust noise intensity and engine rotational speed in the systems of FIGS. 3, 5, and 7.

The dot-dash line of FIG. 6 represents the relationship between exhaust noise intensity and engine rotational speed in the system of FIG. 5. At engine rotational speeds above 2,000 r.p.m., the exhaust noise level of the system of FIG. 6 does not have any significant peaks. The full-dash line of FIG. 6 represents the corresponding relationship in the system of FIG. 3. As shown in FIG. 6, the exhaust noise level of the system of FIG. 5 is considerably smaller than that of the system of FIG. 3 at engine rotational speeds above 2,000 r.p.m. Specifically, the system of FIG. 5 damps the single great peak in exhaust noise resulting from the modes M31 and M41 of FIG. 3.

The pressure damper 31 may be a resonator, such as a Helmholz resonator. In this case, the resonant frequency of the resonator 31 is preferably tuned to the natural frequency f31 or f41 of the system of FIG. 3. The resonant frequency of the resonator 31 may alternatively be tuned to the natural frequency f3 of the system of FIG. 1.

Figure 7:
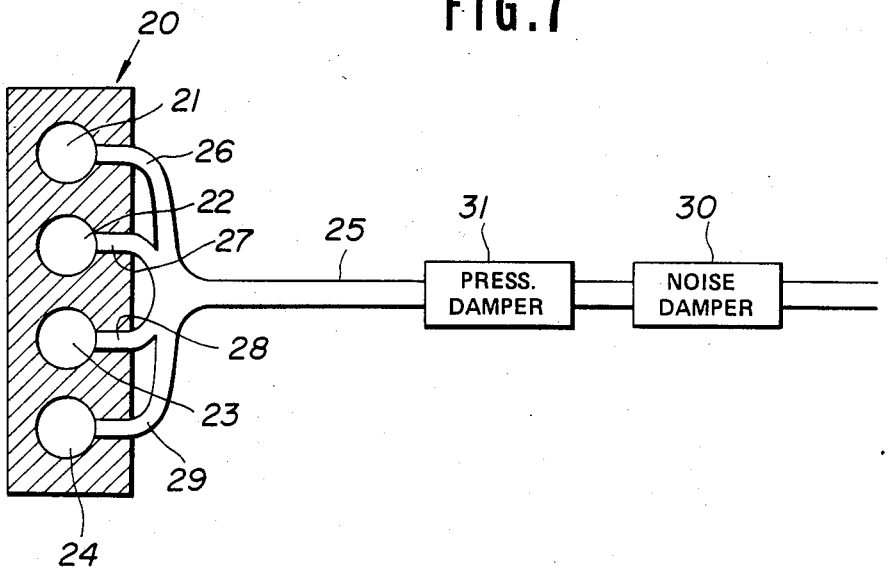
FIG. 7 is a diagram of an exhaust system for an internal combustion engine according to a second embodiment of this invention.

FIG. 7 shows a second embodiment of this invention. This embodiment is similar to the embodiment of FIG. 5 except for the following design change. The pressure damper 31 is connected to the exhaust passage 25 at a point approximately 2L/5 distant (0.4L distant) from the upstream end of the exhaust passage 25, which corresponds to the location of antinode AN1 in FIG. 3. It should be noted that antinodes of the modes M31 and M41 of FIG. 3 lie at this point.

The solid line of FIG. 6 represents the relationship between exhaust noise intensity and engine rotational speed in the system of FIG. 7. The exhaust noise level in the system of FIG. 7 is considerably smaller than the exhaust noise level in the system of FIG. 3 (which is represented by the full-dash line in FIG. 6) at engine rotational speeds above 2,200 r.p.m.

Figure 8:
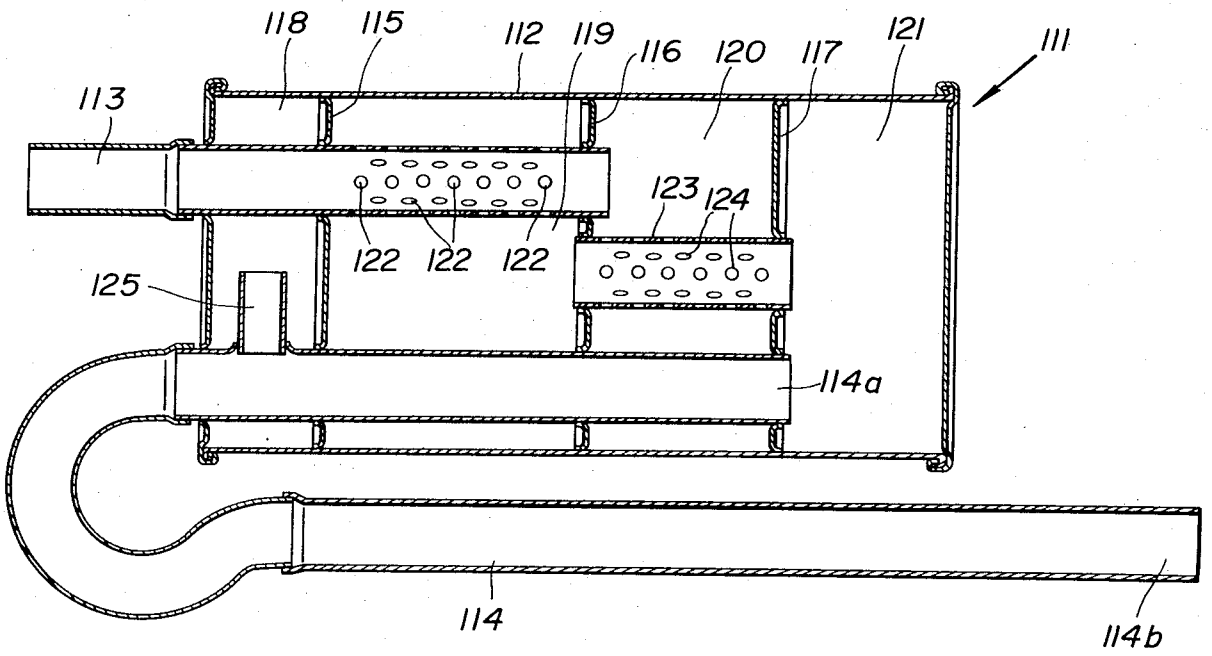
FIG. 8 is a longitudinal section view of an exhaust system for an internal combustion engine according to a third embodiment of this invention.

FIG. 8 shows a third embodiment of this invention. This embodiment is similar to the embodiment of FIG. 5 except for the fact that a muffler and a resonator are housed within a common casing as will be made clear hereafter.

A muffler 111 has a hollow cylindrical casing 112 into which an upstream exhaust pipe 113 and a downstream exhaust pipe 114 extend. The exhaust pipes 113 and 114 define part of an exhaust passage leading away from engine combustion chambers (see FIG. 5). Specifically, the upstream end of the first exhaust pipe 113 is connected to the engine combustion chambers via a front exhaust tube and an exhaust manifold (not shown in FIG. 8). The first and second exhaust pipes 113 and 114 pass axially through the front face of the casing 112. The second exhaust pipe 114 has a U-shaped segment near the front end wall of the casing 112 and then extends rearwards parallel to the cylindrical surface of the casing 112 to its downstream end 114*b* open to the atmosphere.

Axially spaced partition walls 115, 116, and 117 are fixedly disposed within the casing 112. A resonance chamber 118 is defined between the first partition wall 115 and the front face of the casing 112. First, second, and third muffling chambers 119, 120, and 121 are defined between the first and second partition walls 115 and 116, between the second and third partition walls 116 and 117, and between the third partition wall 117 and the rear face of the casing 112, respectively.

The upstream exhaust pipe 113 passes axially through the front face of the casing 112, the first partition wall 115, and the second partition wall 116, and opens into the second muffling chamber 120. In other words, the downstream open end of the exhaust pipe 113 is exposed to the second chamber 120. The segment of the upstream exhaust pipe 113 passing through the first muffling chamber 119 has a plurality of small apertures 122. The downstream exhaust pipe 114 passes axially through the front face of the casing 112, and the partition walls 115, 116, and 117, and opens at its upstream end 114*a* into the third muffling chamber 121. In other words, the upstream open end of the exhaust pipe 114 is exposed to the third chamber 121.

A communication pipe 123 axially extending through the second and third partition walls 116 and 117 connects the first and third muffling chambers 119 and 121. The segment of the communication pipe 123 exposed to the second muffling chamber 120 has a plurality of small apertures 124.

Another communication pipe 125 housed completely within the resonance chamber 118 has one end connected to the downstream exhaust pipe 114. The other end of the communication pipe 125 is open to the resonance chamber 118. The resonance chamber 118 constitutes a Helmholtz resonator, coupled to the exhaust system via the communication pipe 125.

The aperture 122 furthest upstream is approximately 3L/5 distant from the upstream end of the exhaust system, where the value L represents the total effective length of the exhaust system. It should be noted that the location of the furthest upstream aperture 122 defines the location of the connection between the muffler and the exhaust passage.

Similarly, the connection between the downstream exhaust pipe 114 and the communication pipe 125 defines the location of the connection between the resonator and the exhaust passage which is approximately 4L/5 distant (0.8L distant) from the upstream end of the exhaust system corresponding to the location of antinode AN2 in FIG. 3.

In the case where the resonance frequency of the resonator is tuned to the natural frequency f3 equal to the value (5c)/(4L), the dimensions of the communication pipe 125 and the resonance chamber 118 are related as given in the following equation:

$$(5\pi)/(2L)=\sqrt{S/(VB)},$$

where S represents the internal cross-sectional area of the communication pipe 125, B represents the length of the communication pipe 125, and V represents the volume of the resonance chamber 118.

Figure 9:
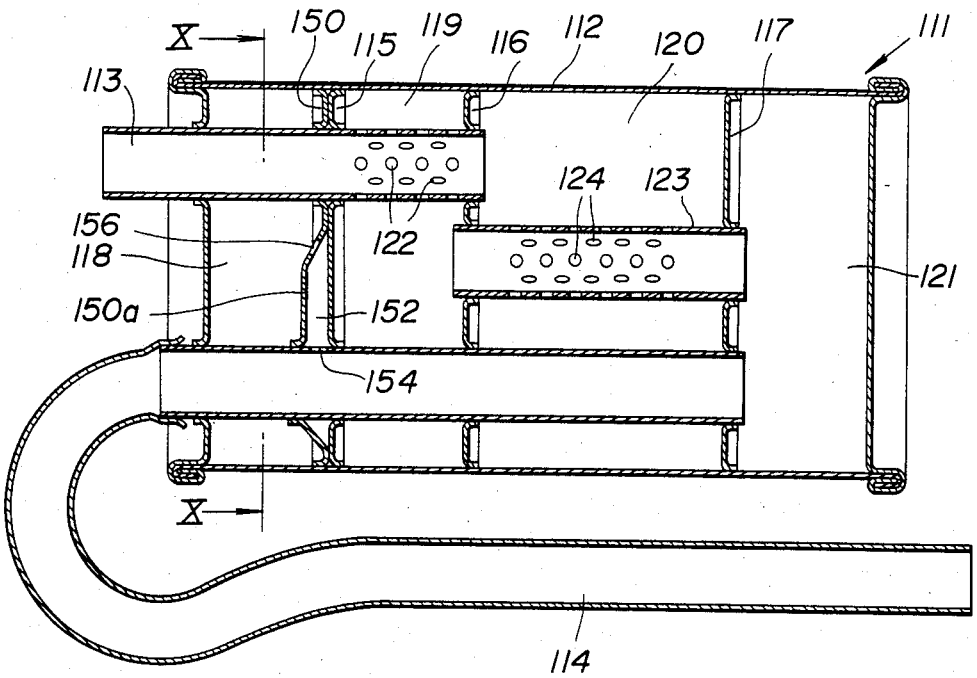
FIG. 9 is a longitudinal section view of a modification of the exhaust system of FIG. 8.
Figure 10:
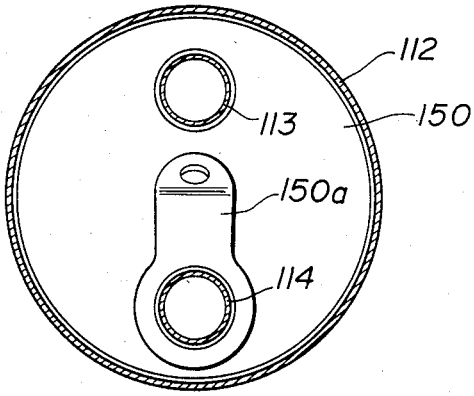
FIG. 10 is a cross-section taken along the line X—X of FIG. 9.

FIGS. 9 and 10 show a modification of the embodiment of FIG. 8, from which the communication pipe 125 (see FIG. 8) is omitted. In this modification, an auxiliary partition wall 150 disposed within the casing 112 adjoins the first partition wall 115. The resonance chamber 118 is defined between the auxiliary partition wall 150 and the front face of the casing 112.

The auxiliary partition wall 150 has a pressed projection 150*a* around the downstream exhaust pipe 114. The projecting wall 150*a* and the first partition wall 115 define a communication passage 152. The downstream exhaust pipe 114 has an opening 154 at one end of the communication passage 152. The projecting wall 150*a* has an opening 156 at the other end of the communication passage 152. The resonance chamber 118 is connected to the exhaust passage via the communication passage 152, and the openings 154 and 156. The structure of this connection is stronger than in FIG. 8.

What is claimed is:

1. An exhaust system for an internal combustion engine having a combustion chamber, the system comprising:

(a) an exhaust passage having an upstream end connected to the combustion chamber and a downstream end open to the atmosphere and developing standing pressure waves upon engine rotation;

(b) means, connected to the exhaust passage, for substantially equalizing natural frequencies of the exhaust passage respectively corresponding to third-degree and fourth-degree modes of said standing pressure waves developing in the exhaust passage by engine rotations above a certain speed; and (c) a pressure damper connected to a point of the exhaust passage at which an antinode of the third-degree or fourth-degree mode lies.

2. The exhaust system of claim 1, wherein the equalizing means comprises a muffler connected to the exhaust passage at a point approximately 3L/5 distant from the upstream end of the exhaust passage, where L represents an effective length of the exhaust passage between its upstream and downstream ends.

3. The exhaust system of claim 2, wherein the pressure damper is connected to the exhaust passage at a point approximately 4L/5 distant from the upstream end of the exhaust passage.

4. The exhaust system of claim 2, wherein the pressure damper is connected to the exhaust passage at a point approximately 2L/5 distant from the upstream end of the exhaust passage.

5. The exhaust system of claim 1, wherein the pressure damper comprises a resonator having a resonance frequency which is equal to one of said natural frequencies of the system.

6. An exhaust system for an internal combustion engine having a combustion chamber, the system comprising:

(a) an exhaust passage having an upstream end connected to the combustion chamber and a downstream end open to the atmosphere;

(b) means for substantially equalizing natural frequencies of the exhaust passage respectively corresponding to third-degree and fourth-degree modes of standing pressure waves developing in the exhaust passage including a muffler connected to the exhaust passage at a point separated from the upstream end of the exhaust passage by an effective length 3L/5, where L represents an effective length of the exhaust passage between its upstream and downstream ends;

(c) pressure damper including a resonator connected to the exhaust passage at a point separated from the upstream end of the exhaust passage by an effective length 4L/5; and (d) a casing housing the muffler and the resonator.

7. The exhaust system of claim 6 wherein the resonator has a resonance frequency equal to a value, where c represents the sound velocity, of a natural frequency given by $f_3=5c/4L$ for third degree resonant mode or by $f_4=7c/4L$ for fourth-degree resonant mode.

8. The exhaust system of claim 6, further comprising:

(a) a partition wall dividing an interior of the casing between the muffler and the resonator;

(b) an exhaust pipe defining a portion of the exhaust passage and extending through the resonator; and (c) a communication pipe disposed within the resonator and having one end connected to the exhaust pipe and the other end opening into the resonator, whereby the communication pipe connects the resonator to the exhaust passage.

9. The exhaust system of claim 6, further comprising:

(a) a main partition wall dividing an interior of the casing between the muffler and the resonator;

(b) an exhaust pipe defining a portion of the exhaust passage and extending through a resonator; and (c) an auxiliary partition wall adjoining the main partition wall and having a pressed projection defining a communication passage in conjunction with the main partition wall, the pressed projection having an opening connecting the resonator to one end of the communication passage, the other end of the communication passage being connected to an opening in the exhaust pipe, whereby the communication passage connects the resonator to the exhaust passage.

* * * * *